US007353952B2

(12) United States Patent
Swartz et al.

(10) Patent No.: US 7,353,952 B2
(45) Date of Patent: Apr. 8, 2008

(54) INSULATED COMPARTMENTED LUNCH BAG

(75) Inventors: John R. Swartz, Ridgewood, NJ (US); Aaron Lown, Tuxedo, NY (US)

(73) Assignee: Built NY, Inc., New York, NY (US)

( * ) Notice: Subject to any disclaimer, the term of this patent is extended or adjusted under 35 U.S.C. 154(b) by 181 days.

(21) Appl. No.: 11/134,977

(22) Filed: May 23, 2005

(65) Prior Publication Data

US 2005/0259894 A1 Nov. 24, 2005

Related U.S. Application Data

(60) Provisional application No. 60/573,629, filed on May 21, 2004.

(51) Int. Cl.

| | |
|---|---|
| ***A45C 11/20*** | (2006.01) |
| ***B65D 30/22*** | (2006.01) |
| ***B65D 33/08*** | (2006.01) |
| ***B65D 81/38*** | (2006.01) |

(52) U.S. Cl. ..... 206/545; 383/10; 383/38; 383/95; 383/97; 383/110; 383/112

(58) Field of Classification Search ..... 206/541, 206/545, 549; 62/457.3, 457.7, 457.2; 383/38–40, 383/110, 95, 97, 10, 112

See application file for complete search history.

(56) References Cited

U.S. PATENT DOCUMENTS

| | | | | |
|---|---|---|---|---|
| 1,808,375 | A | 6/1931 | Plooster | |
| 1,983,418 | A | 12/1934 | Thurmer | |
| 2,123,031 | A | 7/1938 | Weiner | |
| 2,297,375 | A | 9/1942 | Vogt | |
| 3,085,612 | A * | 4/1963 | Gobel | 383/110 |
| 3,763,972 | A * | 10/1973 | Karzmar | 383/110 |
| 4,211,091 | A * | 7/1980 | Campbell | 383/110 |
| D266,048 | S | 9/1982 | Zills | |
| 4,428,484 | A * | 1/1984 | Rattay et al. | 206/548 |
| 4,679,242 | A * | 7/1987 | Brockhaus | 206/545 |
| 4,696,403 | A * | 9/1987 | Hoover | 383/38 |
| 4,872,766 | A * | 10/1989 | Dancy | 383/38 |
| 5,237,838 | A * | 8/1993 | Merritt-Munson | 62/457.2 |
| 5,505,307 | A * | 4/1996 | Shink | 206/545 |
| 5,842,571 | A * | 12/1998 | Rausch | 206/549 |
| D409,450 | S | 5/1999 | Hamilton | |
| D414,083 | S | 9/1999 | Hamilton | |
| D441,612 | S | 5/2001 | Hamilton | |
| D451,665 | S | 12/2001 | Phillips et al. | |
| 6,409,066 | B1 * | 6/2002 | Schneider et al. | 206/545 |
| D462,164 | S | 9/2002 | Phillips | |
| 6,994,131 | B2 * | 2/2006 | Dedmon | 383/38 |
| 7,219,814 | B2 * | 5/2007 | Lown et al. | 383/38 |
| 2002/0166779 | A1 | 11/2002 | Etesse et al. | |

* cited by examiner

*Primary Examiner*—Bryon P Gehman
(74) *Attorney, Agent, or Firm*—Lackenbach Siegel LLP; Robert M. Bauer

(57) ABSTRACT

A bag has a first compartment for receiving a food item, a second compartment for receiving a beverage container, the second compartment having an open end for receiving the beverage container and a closed end opposite the open end. The closed end has a rounded profile when the bag is in a flattened condition, and is radially expandable to allow the bag to stand upright.

13 Claims, 6 Drawing Sheets

INSULATED COMPARTMENTED LUNCH BAG

RELATED APPLICATION

This application claims priority from U.S. Provisional Patent Application Ser. No. 60/573,629, filed on May 21, 2004.

BACKGROUND OF THE INVENTION

1. Field of the Invention

The present invention relates generally to hand totes. Particularly, the present invention relates to a multi-chambered bag for carrying meals and beverages.

2. Description of the Prior Art

Portable containers for portable food storage have been known for years. Paper lunch bags are one example of known containers for portable food storage and can be discarded or folded for storage and subsequent use.

Lunch bags are typically packaged in a flat position and expanded when filled with food items. The top of the bag is usually rolled or folded to seal the contents of the bag and provide a means to more readily grab the paper. Because of the physical characteristics of paper, the folded portion tends to relax toward an open position so that the contents of the bag are not completely sealed. The paper construction of the bag is also conducive to damage when folded and used to carry food items. For this reason, the bags are typically discarded after a single use. Additionally, paper lunch bags are relatively poor thermal insulators, such that enclosed food items can become warm or cold and even spoiled.

Metal lunch boxes are another known means for food storage. Although lunch boxes are reusable and are typically provided with an easy to carry handle, the boxes are usually heavy, bulky and difficult to store. Additionally, metal is a poor thermal insulator and is relatively expensive to produce. It is therefore desirable to have a reusable insulated container that can store food items and allow the user to easily carry and seal the contents of the container.

It is also desirable to have a reusable insulated container that can store one or more beverage items and one or more food items at different temperatures.

The lunch bag of the present invention addresses and resolves the aforesaid art desired needs.

SUMMARY OF THE INVENTION

It is a principal object of the present invention to provide an improved lightweight, flexible, insulated lunch bag, which maintains a food item and a beverage at separate temperatures.

It is also an object of the present invention to provide an insulated bag for transportation and temporary storage of food and beverage without spoilage thereof.

It is a further object of the present invention to provide a pliable lunch bag which may easily be manufactured at low cost from readily available materials.

These and other objects and advantages are achieved by a bag for carrying articles comprising a first compartment for receiving a food item, said first compartment being formed of a stretchable insulating material, a second compartment for receiving a beverage container, said second compartment having an open end for receiving said beverage container and a closed end opposite said open end, said closed end having a rounded profile when said bag is in a flattened condition, said rounded end being radially expandable to allow said bag to stand upright, said second compartment being formed of a stretchable insulating material, a connecting means for connecting said first and second compartments and for keeping the contents of said first and said second compartments separate from one another, and a closure means for closing at least said first compartment, wherein said second compartment is conformable to diverse beverage container shapes and allows ready accessibility of said beverage container.

The foregoing and still other objects and advantages of the present invention will be more apparent from the following detailed explanation of the preferred embodiments in connection with the accompanying drawings.

BRIEF DESCRIPTION OF THE DRAWINGS

By way of example only, preferred embodiments of the present disclosure will be described herein with reference to the accompanying drawings, in which.

DETAILED DESCRIPTION OF THE INVENTION

Figure 2:
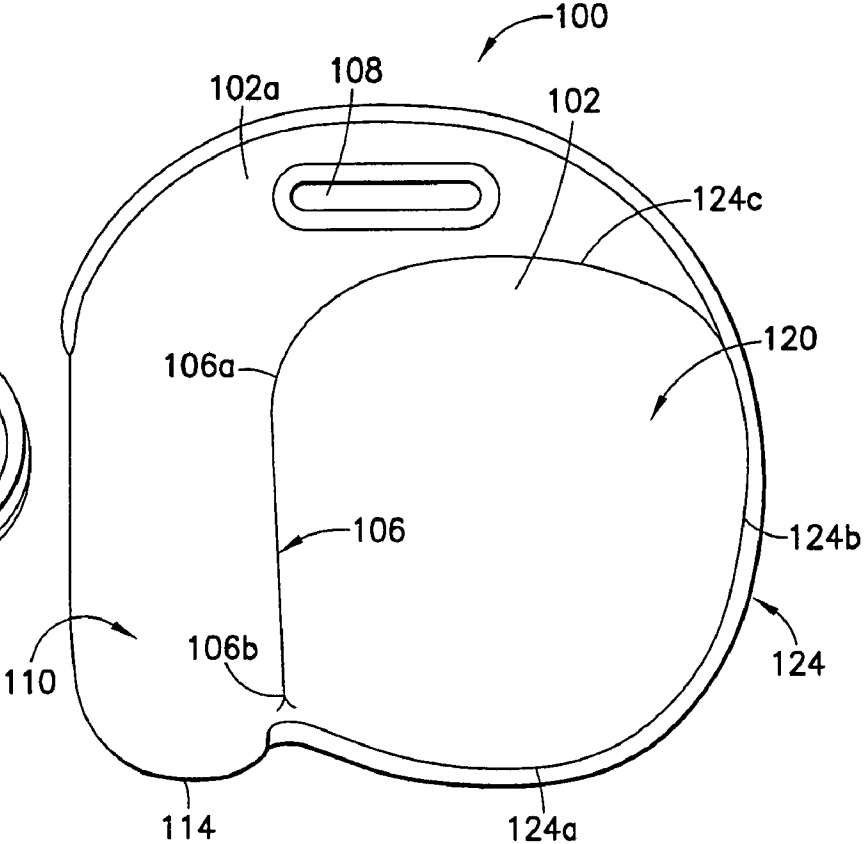
FIG. 2 is a front elevational view of the lunch bag of FIG. 1, the rear elevational view being a mirror image of the front elevational view.
Figure 1:
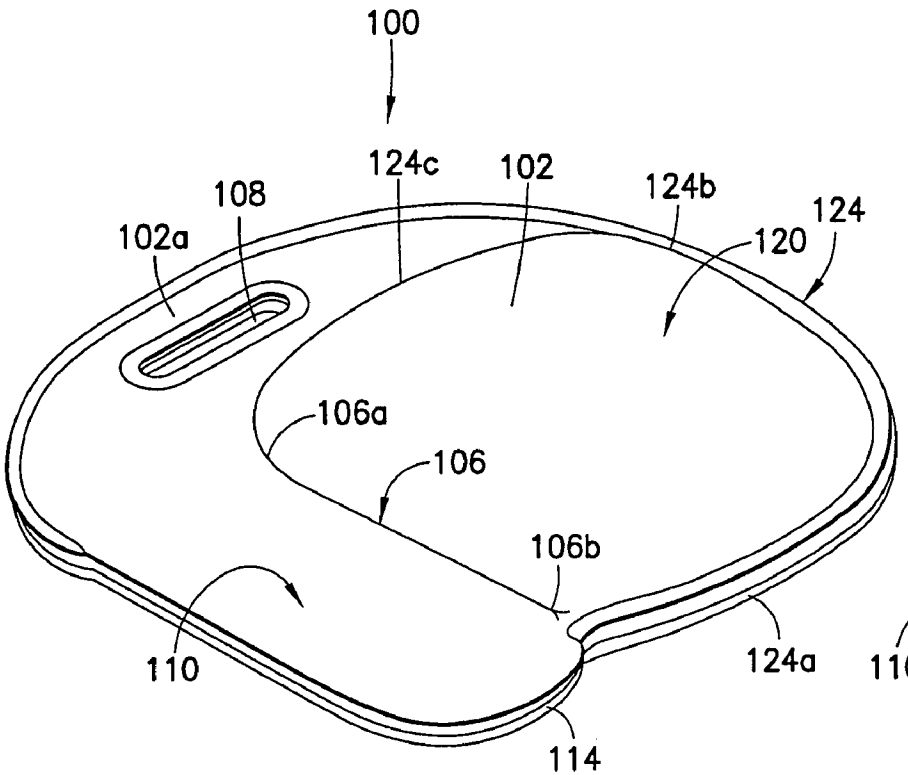
FIG. 1 is a perspective view of a lunch bag, in accordance with a first embodiment of the present invention, shown in a flattened condition.
Figure 4:
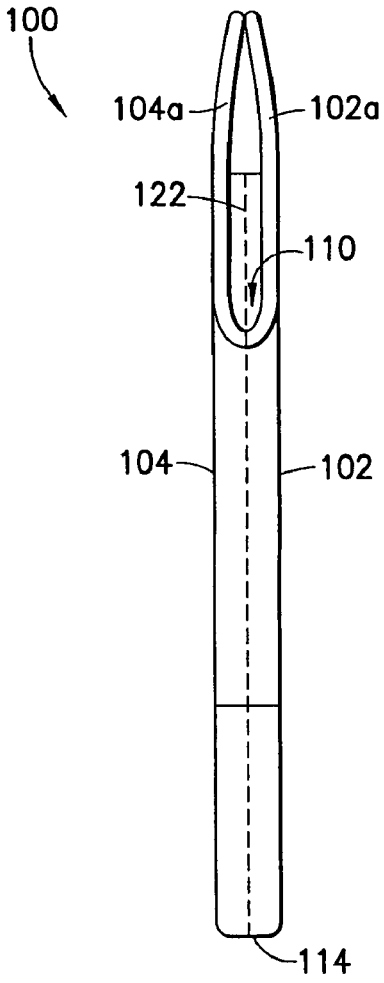
FIG. 4 is a left side elevational view of the lunch bag of FIGS. 1-3.
Figure 3:
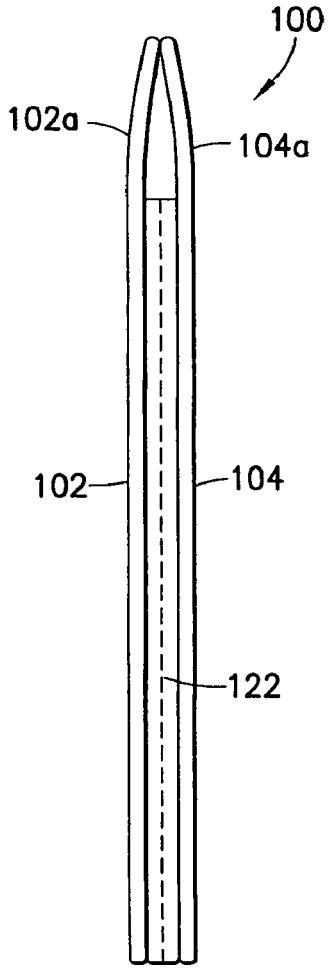
FIG. 3 is a right side elevational view of the lunch bag of FIGS. 1 and 2.
Figure 5:
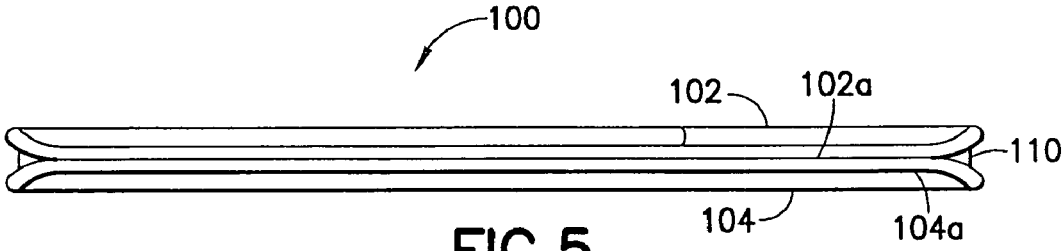
FIG. 5 is a top plan view of the lunch bag of FIGS. 1-4.
Figure 6:
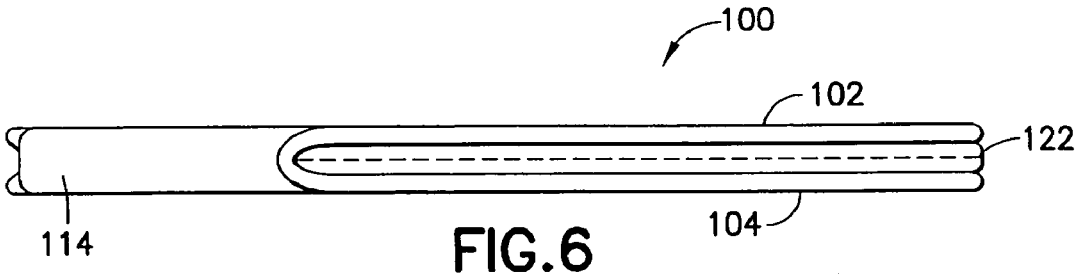
FIG. 6 is a bottom plan view of the lunch bag of FIGS. 1-5.
Figure 8:
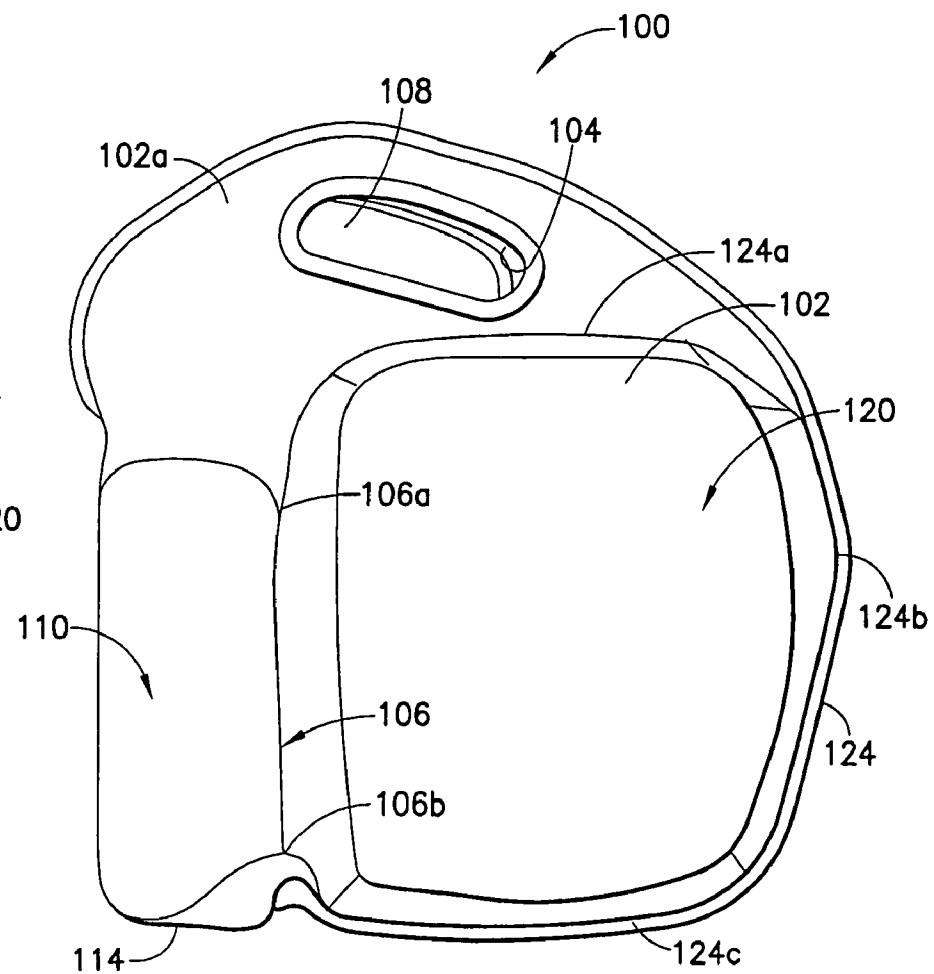
FIG. 8 is a front elevational view of the lunch bag of FIG. 7, the rear elevational view being a mirror image of the front plan view.
Figure 7:
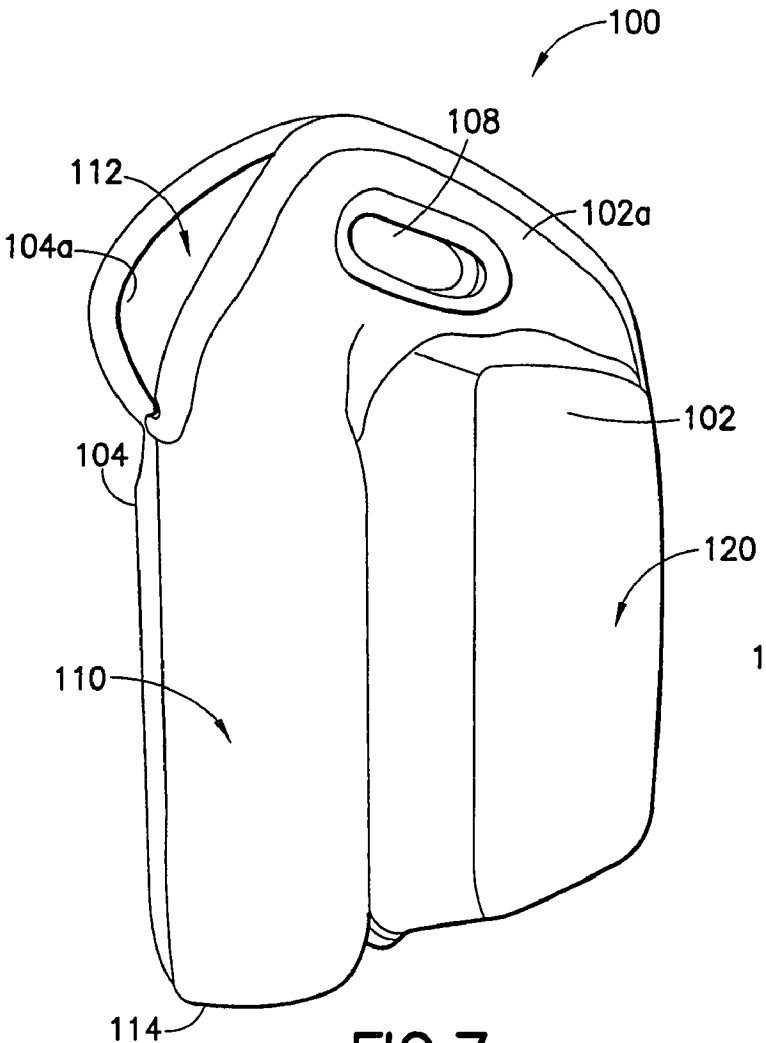
FIG. 7 is a perspective view of the lunch bag of FIGS. 1-6, shown in an expanded condition containing totable items therein.
Figure 9:
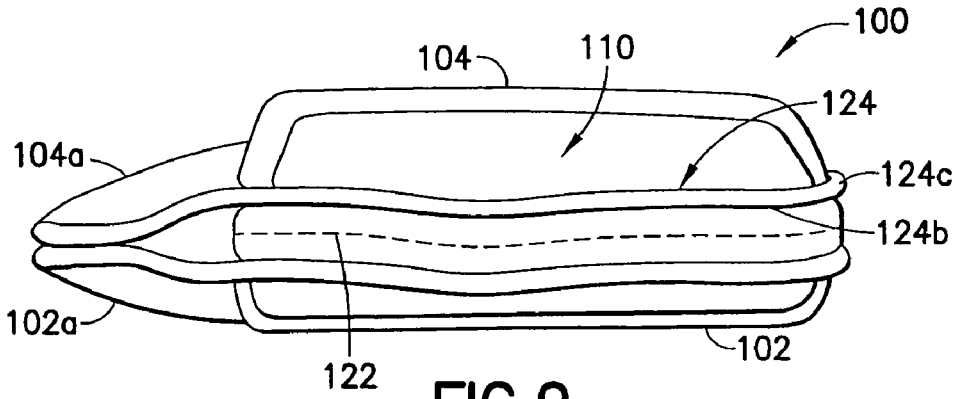
FIG. 9 is a right side elevational view of the lunch bag of FIGS. 7 and 8.
Figure 10:
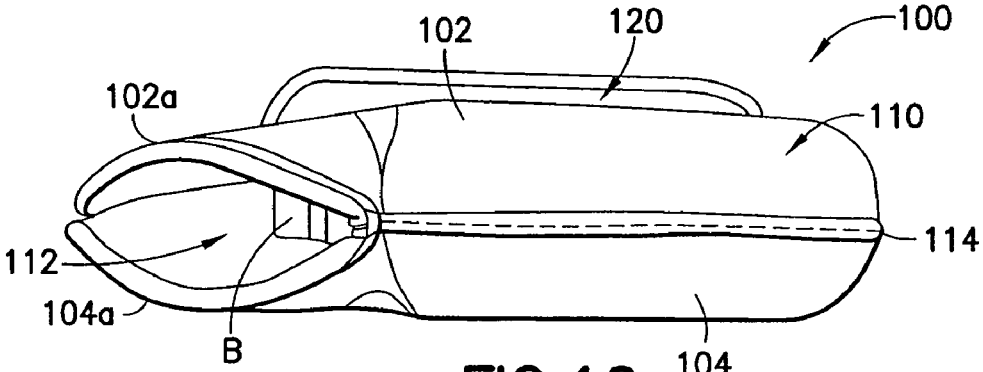
FIG. 10 is a left side elevational view of the lunch bag of FIGS. 7-9, having a totable item in the form of a bottle, shown in phantom, disposed therein.
Figure 11:
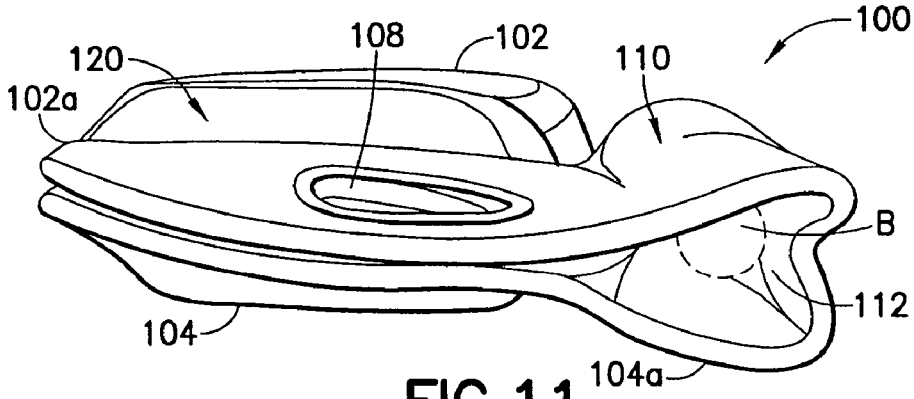
FIG. 11 is a top plan view of the lunch bag of FIGS. 7-10, having a totable item in the form of a bottle, shown in phantom, disposed therein.
Figure 12:
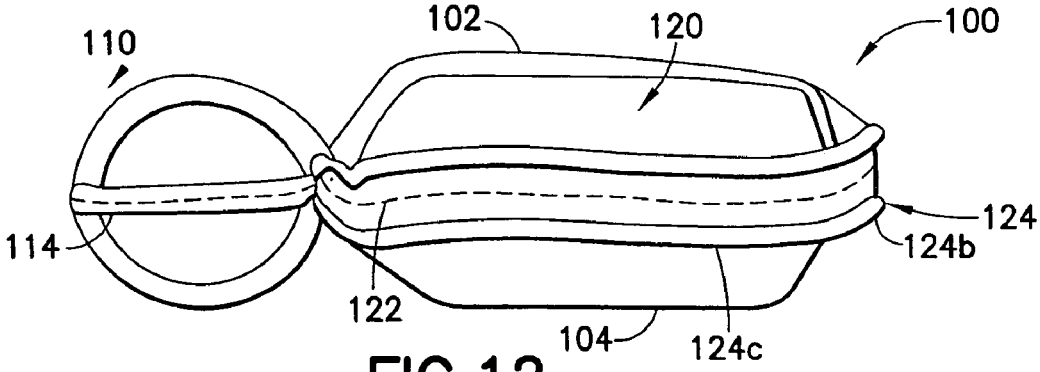
FIG. 12 is a bottom plan view of the lunch bag of FIGS. 7-11.
Figure 13:
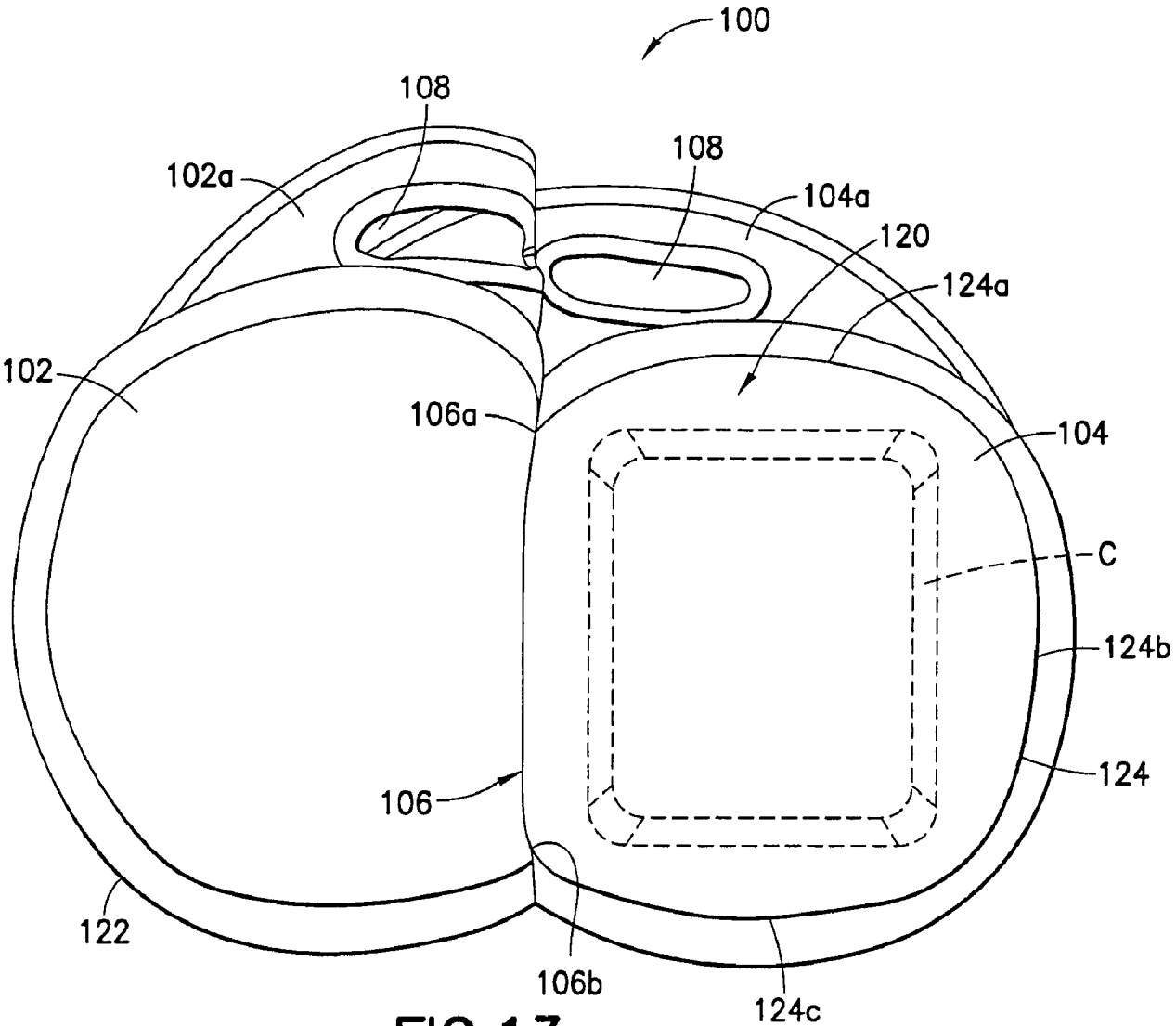
FIG. 13 is a front elevational view of the lunch bag of FIGS. 1-12, illustrating a compartment thereof in an open condition and having a totable item in the form of a container, shown in phantom, disposed therein.

With reference to FIGS. 1-13, a hand tote for use as a lunch bag and the like is shown generally as 100. Bag 100 includes at least one compartment and preferably several compartments. In a preferred embodiment, bag 100 has a first or minor compartment 110 and a second or major compartment 120. It is envisioned that chambers 110, 120 are configured and sized to receive and/or retain a beverage and a meal, respectively. While two compartments are shown it is understood and within the scope of the present disclosure that a plurality of compartments may be provided. Specifically, bag 100 may have several minor compartments 110 for storage of multiple beverage containers. Preferably, minor compartment 110 and major compartment 120 are separated from one another by a contact line 106, securing a front panel 102 to a rear panel 104 of bag 100 to one another. Although the present invention is described as being used to store and carry food items, it is to be understood that the bag 100 can be used to hold other items.

In an alternate embodiment of bag 100 (not shown), major compartment 120 has one or more additional compartments formed therein. Specifically, major compartment 120 may have a separate closable compartment on a front panel thereof and a separate closable compartment on a back panel thereof. The separate closable compartments may be used to store additional food items, utensils, condiments, napkins or the like.

Bag 100 may be formed of one or more layers of insulating and non-insulating material. Preferably, bag 100 is constructed of nylon covered neoprene. While bag 100 is preferably fabricated from nylon coated neoprene, it is envisioned that bag 100 may be fabricated from, and not limited to, neoprene laminated with one of leather, vinyl, polyester, cotton and the like. Additionally, it is envisioned that the neoprene may be replaced with foam rubber, synthetic rubber, natural rubber, or other elastic and partially elastic materials.

Bag 100 is used for the easy and comfortable portage of a meal container "C" (shown in phantom in FIG. 13) and a beverage container "B" (shown in phantom in FIGS. 10 and 11) all in one bag, while insulating and protecting the contents (e.g., containers "B and C") within bag 100 from outside objects. Bag 100 is also configured to protect the meal container "C", in major compartment 120, from making direct contact with beverage container "B", in minor compartment 110. In particular, bag 100 keeps the contents retained in minor compartment and major compartment 110, 120 separate from one another, preferably, insulated from one another so that the particular items retained in minor compartment and major compartment 110, 120 may be maintained at different temperatures.

The material of construction of bag 100 allows bag 100 and, particularly minor compartment and major compartment 110, 120, to accommodate varying sized food storage containers "C" (e.g., plastic containers such as Tupperware®, bags and the like), using no separate hardware or moving parts, aside from a zipper provided around the major compartment 120, as will be described in greater detail below. In other words, the neoprene material stretches and conforms, as necessary, to accommodate various sizes and shapes of storage containers.

Minor compartment 110 is desirably configured and sized to receive and retain at least one beverage container "B" (e.g., can or bottle). Since bag 100, and particularly, minor compartment 110 is fabricated from neoprene, minor compartment 110 may stretch and conform to a number of shapes and sizes of beverage containers "B" without the need or use of snaps, zippers or catches for retaining the beverage container "B" therein. Minor compartment 110 also allows for beverage container "B" to be accessed from outside bag 100 without having to unzip and/or otherwise open major compartment 120. It should be noted that, while not necessary, fasteners may be employed for secure storage of a beverage container in minor compartment 110.

Minor compartment 110 defines an open end 112 for receiving beverage container "B" therein, and a closed end 114, opposite open end 112. Preferably, closed end 114 has a rounded profile when bag 100 is in a flattened condition. As such, when an item, e.g., a beverage container "B", is fully inserted into minor compartment 110, closed rounded end 114 will radially expand and substantially flatten, thereby allowing bag 100 to stand upright.

Major compartment 120 includes a substantially rounded perimetral edge 124, including at least one of a rounded lower edge 124*a*, a rounded side edge 124*b* and a rounded upper edge 124*c*. Perimetral edge 124 is desirably rounded such that when a container "C" is retained therein and perimetral edge 124 is closed along the length thereof, rounded lower, side and upper edges 124*a*-124*c* become substantially flat. Flattened lower edge 124*a* cooperates with flattened rounded end 114 of minor compartment 110 in order to increase the ability of bag 100 to stand upright.

Figure 14:
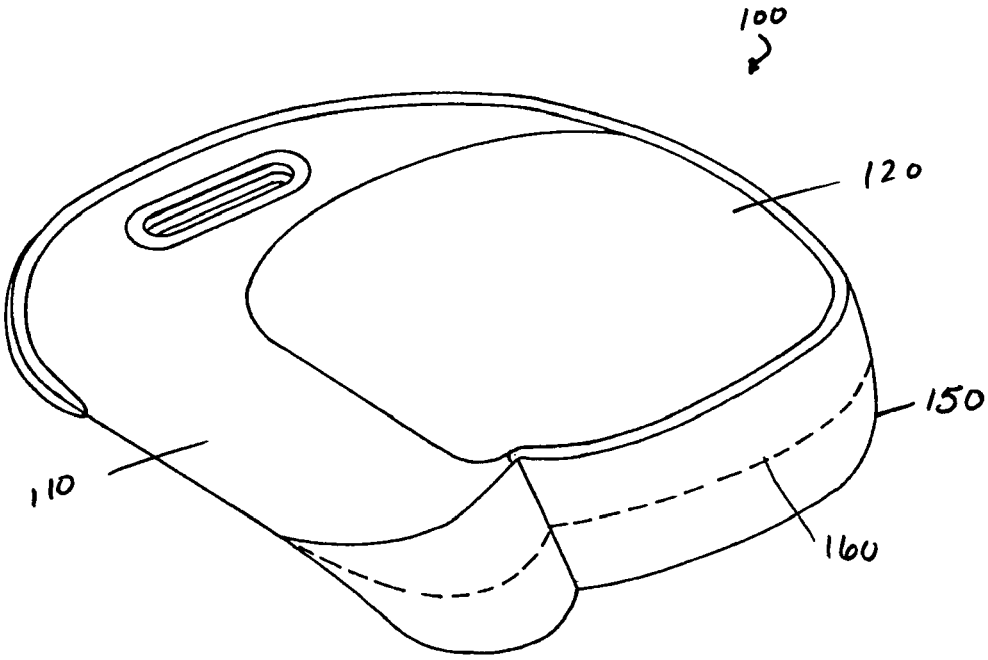
FIG. 14 is a perspective view of the lunch bag in accordance with a second embodiment of the present invention, shown in an expanded condition.
Figure 15:
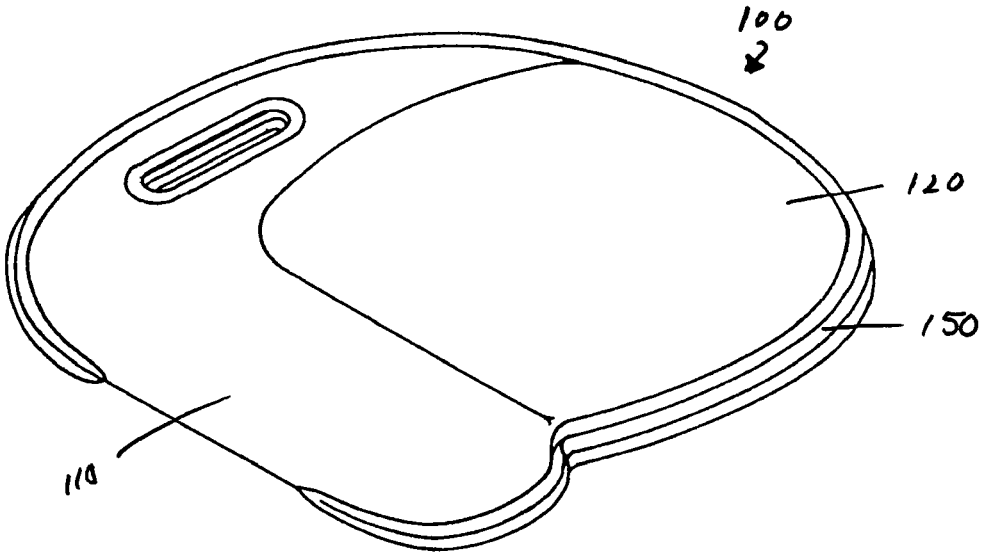
FIG. 15 is a perspective view of a lunch bag, in accordance with a second embodiment of the present invention, shown in a folded condition.

In an alternate embodiment shown in FIGS. 14 and 15, bag 100 has a bottom panel 150 that spans the entire bottom of bag 100, forming the bottom panel of major compartment 120 and minor compartment 110. Bottom panel 150 allows bag 100 to stand upright and allows for multiple food containers to be stacked in an upright position in major compartment 120. Bottom panel 150 further has a fold line 160 therein that allows bag 100 to be folded in half and bottom panel 150 to be folded on itself so that bag 100 can be flattened for storage, as illustrated in FIG. 15.

Referring again to FIGS. 1 to 13, bag 100 includes closing means 122, in the form of a zipper or the like surrounding at least a portion of one of compartments 110, 120. Preferably, zipper 122 extends substantially along perimeter edge 124 of major compartment 120, from a top 106*a* of contact line 106 to a bottom 106*b* of contact line 106. In the second embodiment of the present invention shown in FIGS. 14 and 15, zipper 122 extends substantially along perimeter edge 124 of major compartment 120, from a top 106*a* of contact line 106 and along edge 124.

Referring again to FIGS. 1 to 13, when the items are removed from minor compartment and major compartment 110, 120, bag 100 may be unzipped and folded completely open (like a book, as seen in FIG. 13) and may function as a convenient and comfortable placemat to eat on. Additionally, any crumbs or stains from eating are contained on the interior side or surfaces of the major compartment 120. Thereafter, major compartment 120 may be closed to hide the said crumbs or stains therein and out of sight.

It should be noted that closing means 122 may be, by way of non-limiting example, Velcro, a zip lock slider, buttoning means or any other fastening means known in the art.

It should also be noted that bag 100 may be completely separable. Specifically, major compartment 110 may be completely separable from minor compartment 120. In this manner, major compartment 110 and minor compartment 120 may be interchangeable with like compartments of varying size, shape or design. In this embodiment, major compartment 110 and minor compartment 120 may be attached by zippers, zip lock fasteners, Velcro© or any other resealing means known in the art.

When bag 100 is not in use (e.g., empty), bag 100 may be laid completely flat or rolled-up for easy storage. Accordingly, when bag 100 is not in use, bag 100 may be easily fit into briefcases, handbags, backpacks, drawers, glove boxes, etc. Additionally, the ability for bag 100 to lay flat allows for lower shipping and storage costs for retailers and/or suppliers as compared to more voluminous insulated meal containers. Further, bag 100's flat when not loaded construction also allows the bag 100 to lower the instances of wrinkling or damaging to the neoprene material during shipping or storage, and/or having to be stuffed inside with packing material to avoid wrinkling or damage during shipping or storage. Other bags constructed having an inside volume when empty are susceptible to being crushed, wrinkled or otherwise damaged by the weight of other bags or objects placed in the case or container during shipment or storage. This situation applies to suppliers, retainers, and the end users.

Since bag 100 is preferably fabricated from neoprene, bag 100 is machine and/or hand washable.

Bag 100 may further include a handle 106 defined by a front flap 102*a* extending from front panel 102 and a rear flap 104*b* extending from rear panel 104. Preferably, front and rear flap 102*a*, 104*a* extend from front and rear panels 102, 104, along a common side as open end 112 of minor compartment 110 and rounded upper edge 124*c* of major compartment 120. Each flap 102*a*, 104*a* includes a hand hold 108 formed therein. Since bag 100 is preferably fabricated from neoprene, hand hold 108 has a degree of comfort for the carrier.

Alternately, handle 106 may be a flexible, adjustable carrying strap (not shown), which may be formed, if desired, of the same material as bag 100. The strap is affixed by stitching or sewing one end thereof to edge 124 of major compartment 120, the other free end of the strap being detachably fastened to minor compartment 110 by conventional cooperating snaps or the like fasteners.

It will be understood that various modifications may be made to the embodiments disclosed herein. For example, while a bag having two compartments has been shown and described, it is envisioned that bags having any number of compartments may be provided and it is anticipated that bag 100 may be modified for use with a carrying straps, such as, a shoulder strap. Accordingly, the above description should not be construed as limiting, but merely as an exemplification of preferred embodiments. Those skilled in the art will envision other modifications within the scope and spirit of the claims appended hereto.

What is claimed is:

1. A bag for carrying articles comprising:

a first side panel formed of a stretchable insulating material;

a second side panel, opposing said first side panel and formed of the same stretchable insulating material as said first side panel;

a contact line securing part of said first side panel and second side panel to one another, and separating the space between said first and second side panels; into first and second compartments, said second compartment being shaped for receiving a beverage container and having an open top end for receiving the beverage container and a closed end opposite said open top end; and a perimetral edge around the perimeter of said first compartment, except that part of the perimeter of said first compartment formed by said contact line, said perimetral edge having a closure means for selectively closing said first compartment, wherein said first compartment is conformable to contents in a sideways direction, and said second compartment is conformable to diverse beverage container shapes to bulge in the sideways direction and allows ready accessibility to a beverage container via said open top end when said first compartment is closed.

2. A bag as claimed in claim 1, wherein said first compartment further comprises a substantially rounded edge including at least a rounded lower edge, a rounded side edge and a rounded upper edge.

3. A bag as claimed in claim 2, wherein said first compartment rounded lower edge cooperates with said second compartment closed end thereby enabling said bag to stand upright.

4. A bag as claimed in claim 1, wherein said first side panel and said second side panel have respective counter-facing top edges above said first compartment and said second compartment, thereby defining top parts of said first and second side panels, said top parts not being secured to each other and further comprising a handle for carrying said bag.

5. A bag as claimed in claim 1, wherein said closure means is selected from the group comprising a zipper, a hook and loop fastener, a zip lock slider and a button.

6. A bag as claimed in claim 1, wherein said first compartment and said second compartment are completely separable from each other.

7. A bag as claimed in claim 1, wherein said closure means may be completely unfastened to allow said bag to be used as a mat.

8. A bag as claimed in claim 7, wherein said closure means comprises a zipper extending substantially along said perimetral edge of said first compartment.

9. A bag as claimed in claim 1, wherein said contact line enables said first and said second compartments to be maintained at different temperatures.

10. A bag as claimed in claim 1, wherein said first and second side panels are constructed of neoprene.

11. A bag as claimed in claim 1, wherein said first and second side panels are constructed of nylon coated by a laminate selected from the group consisting of leather, vinyl, polyester, plastic and cotton.

12. A bag for carrying articles as claimed in claim 1, further comprising:

a bottom panel which forms a closed end of said first and said second compartments, said bottom panel enabling said bag to stand upright when in an extended position.

13. A bag as claimed in claim 12 wherein said bottom panel has a fold line therein, thereby allowing said bag to be folded flat when not in use.

* * * * *